United States Patent [19]

Hedlund et al.

[11] Patent Number: 4,730,571

[45] Date of Patent: Mar. 15, 1988

[54] PONTOON BOAT

[75] Inventors: Lorry L. Hedlund; Kevin B. Hedlund, both of New Hope, Minn.

[73] Assignee: Lee-Zure Line Inc., New Hope, Minn.

[21] Appl. No.: 912,995

[22] Filed: Sep. 26, 1986

[51] Int. Cl.[4] ..... B63H 5/08

[52] U.S. Cl. ..... 114/61; 440/6

[58] Field of Search ..... 114/61, 123, 66, 125, 114/283; 440/6

[56] References Cited

U.S. PATENT DOCUMENTS

| | | | |
|---|---|---|---|
| 3,517,632 | 6/1970 | Gray | 114/61 |
| 3,626,894 | 12/1971 | Stuart | 440/69 |
| 3,848,561 | 11/1974 | Price | 440/69 |
| 4,276,851 | 7/1981 | Coleman | 114/66 |
| 4,537,144 | 8/1985 | Horton | 114/61 |

FOREIGN PATENT DOCUMENTS

| | | | |
|---|---|---|---|
| 265918 | 3/1913 | Fed. Rep. of Germany | 114/283 |
| 2552021 | 5/1977 | Fed. Rep. of Germany | 114/123 |

*Primary Examiner*—Sherman D. Basinger
*Assistant Examiner*—Edwin L. Swinehart
*Attorney, Agent, or Firm*—Clayton R. Johnson

[57] ABSTRACT

A pontoon boat that includes a pair of pontoons, a chair, a parallel linkage system for maintaining the pontoons in spaced apart parallel relationship and mounting the chair for movement between a position the chair seat is at a higher elevation than the pontoons and a position at a lower elevation than the surface of the body of water in which the pontoon boat is being used, power operated mechanism within one of the pontoons for operating the linkage system to move the chair between its positions, a motor mounted by each of the pontoons for propelling the boat, the propelling motors being operable at different speeds and/or forward and reverse for controlling steering, and controls mounted adjacent to the chair for controlling operation of the propelling motors and the power source for operating the linkage system, each pontoon having a compartment that may be flooded with water and a pump for pumping water out of the compartment.

11 Claims, 8 Drawing Figures

PONTOON BOAT

BACKGROUND OF THE INVENTION

In the prior art it is old to provide a pontoon boat that includes a pair of pontoons, a deck mounted on the pontoons that retains the pontoons in spaced apart parallel relationship and a motor for propelling the boat. However the deck is mounted to be retained above the level of the body of water in which the boat is used.

SUMMARY OF THE INVENTION

A pontoon boat that includes a pair of elongated pontoons, a chair for supporting the user, linkage mechanism to maintain the pontoons in spaced apart parallel relationship, move the chair between a position the chair seat is above the pontoons and a position the chair seat is below the surface of the body of water in which the boat is used, and a motor for operating the linkage mechanism to move the chair seat between its positions.

One of the objects of this invention is to provide a new and novel pontoon craft. A further object of this invention is to provide a new and novel leisure craft for selectively retaining a user above the level of an out door body of water and alternately in a partially immersed condition in said body of water. In furtherance of the last mentioned object, it is an another object of this invention to provide a pontoon craft having pontoons, a chair and linkage mechanism for maintaining the pontoons in parallel relationship and moving the chair between elevated and lowered positions and that may be readily disassembled for transport of the craft between a place of storage and a place of use.

BRIEF DESCRIPTION OF THE DRAWINGS

FIG. 1 is a side view of the pontoon boat of this invention with parts of one of the side walls of one of the pontoons broken away, the chair and parallel linkage system being shown in a chair elevated position in solid lines, parts of the linkage system and chair leg rest being shown in a chair lowered position in dotted lines, and the length of the chair seat and the longitudinal spacing of the linkage members being exaggerated to facilitate the illustration of the invention;

Figures 2, 3, 7:
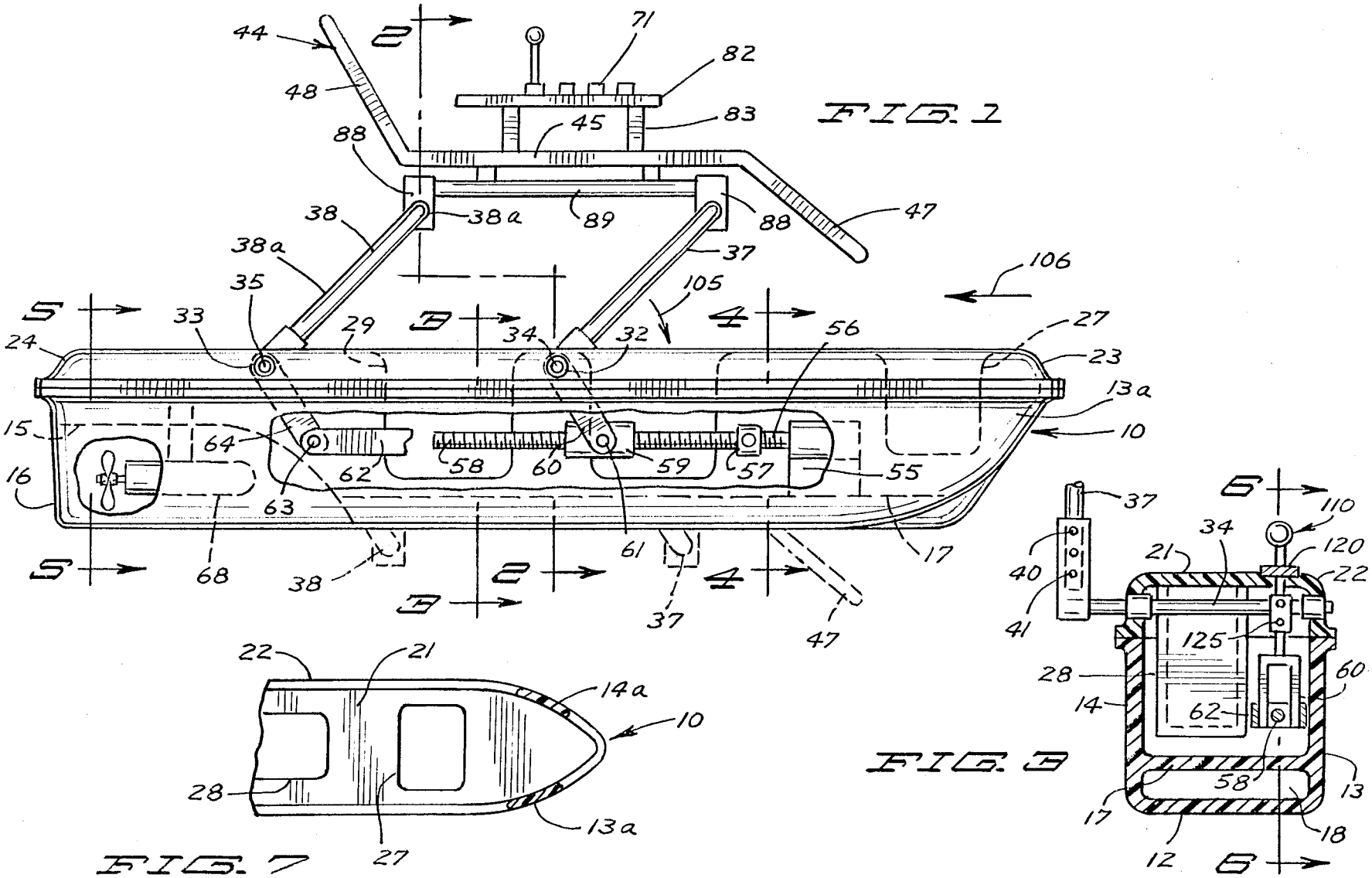
FIG. 2 is a transverse cross sectional view generally taken along the line and in the direction of the arrows 2—2 of FIG. 1 other than only portions of the pontoons are shown.
FIG. 3 is an enlarged transverse cross sectional view of one of the pontoons that is generally taken along the line and in the direction of the arrows 2—2 of FIG. 3, the width of the clevised crank arm and associated structure being exaggerated and the relative widths of the compartment being diminished in order to facilitate the showing of the crank arm.
FIG. 7 is a fragmentary plan view of the front end of one of the pontoons.
Figure 2:
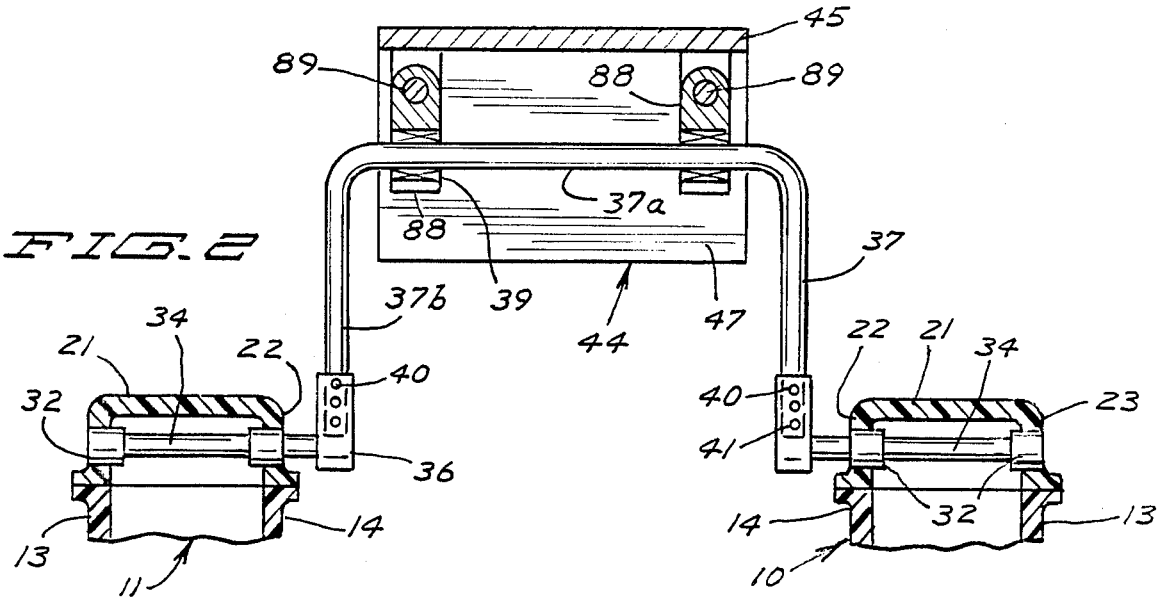

Referring in particular to FIGS. 1 and 2, the pontoon boat of this invention includes a pair of elongated pontoons, generally design designated 10 and 11 respectively that advantageously are made of a fiberglass reinforced resin mixture. Each of the pontoons is of the same construction, including size and shape (other than one being a right hand pontoon and the other a left hand pontoon and includes an upper section and a lower section. Each pontoon lower section includes a bottom wall 12, side walls 13, 14 that have their front end parts curved toward one another along portion 13*a*, 14*a* to be joined at a rounded front end, a somewhat U-shaped rear wall 16 and a tunnel wall 15 that is transversely centered between the rear ports of the side walls, is somewhat U-shaped in transverse cross section, and in longitudianal cross section arcuately curved in an upward and rearward direction from the bottom wall and thence extends nearly linearly rearwardly to form a tunnel wall that opens rearwardly and downwardly. Walls 13–16 are joined together to form a water tight structure that opens upwardly. A generally horizontal wall 17 is joined to the side walls, the rear wall and the tunnel wall to in cooperation therewith and the bottom wall form a ballast tank 18.

Each upper pontoon section includes a top wall 21, side walls 22, 23 that for the most of their lengths extend nearly parallel to one another but at their front parts are arcuately curved toward one another in a forward direction to be joined at a rounded nose and a rear wall 24 joined to the top and side walls. The lower edge portions of the upper sections side and rear walls are integrally joined to flange portions forming upper section peripheral flanges that are joined in water tight relationship (for example being bolted to) to the adjacent peripheral flange of the respective lower pontoon section that are integrally joined to the side and rear walls of the lower section.

The top wall 21 of each section is generally planar except for being rounded at the edge portions thereof that are joined to the rear and side walls. Further each top wall has dependingly joined thereto a plurality of upwardly opening storage compartments, for example a first, an intermediate and a rear compartment designated 27, 28 and 29 respectively. That is each compartment has front, rear and side walls integrally joined to the top wall in depending relationship thereto and a bottom wall adjacent to and above divider wall 17. The rear compartments are located forwardly of the tunnel walls. Advantageously covers (not shown) are provided for removably covering the compartments.

Each upper pontoon section side wall mounts a front bushing 32 and a rear bushing 33, the front bushings of each section pivotally mounting a front transverse shaft 34 and the rear bushings pivotally mounting a rear transverse shaft 35 that is longitudinally spaced from and parallel to shaft 34. Shafts 34, 35 extend through the side walls 22 of the pontoons toward one another, the adjacent end portions of shafts 34 mounting tubular brackets 36 that are welded or otherwise secured thereto in a fixed anular relationship while the adjacent end portions of shafts 35 likewise mount tubular brackets 36.

For the front brackets there is provided a generally U-shaped front linkage member 37 that has radially extending arm portions (legs) 37*b* with the radial inner end parts thereof extended into the respective bracket 36. Each bracket 36 has a plurality of apertures 40 that are progressively radially spaced from the central axis of the shaft on which the bracket is mounted to have a quick lock pin 41 extended through the desired aperture and an aperture (not shown) in the respective arm portion radial inner terminal end part. This permits a disassembly operation, and as will become more apparent hereinafter, an adjustment feature. The generally U-shaped rear linkage member 38 has radial linkage arm portions (legs) 38*b* that are likewise removaly mounted by the brackets 36 to the shafts 35.

The radial outer ends of each of the linkage arm portions is integrally joinded through arcuately curved portions that in turn are joined to a transverse shaft portion 38*a*. Bearings 39 are provided on shaft portion 38*a* on which there is respectively mounted a casting 88. Similarly bearings 39 are mounted on the transverse shaft portion 37*a* of linkage member 37, shaft portion 37*a* being integrally joined to arcuately curved portions that in turn are integrally joined to the respective arm portion 37*b*. Transverse apertures in castings 88 in which the bearings 39 are mounted are sufficiently large to in conjunction with the curvature of the arcuately curved portions of the linkage members 37, 38, the arm portions may be moved through the transverse apertures and onto the shaft portions while the bearings are made nylon so that the bearings may be moved along the linkage members and into the transverse apertures to the positions shown in FIG. 2 for shaft 37*a*. When the linkage members are in an assemblied condition the shafts are in parallel relationship and the arms are also parallel to one another. Appropriate means are provided for retaining the castings in proper axial spaced relationship on shafts 37*a*, 38*a*.

Each linkage member 37, 38 instead of being one intergral member, may be separate arms 37*b*, 38*b* and shafts 37*a*, 38*a* with the arms mounting bearings 39 and the bearings mounting the shafts which in turn have the castings mounted thereon whereby the shafts are rotatable relative to the arms. In such an event the shafts may or may not be rotatable relative to the castings.

Each of the castings 88 has a second bore extending therethrough for having an end portion of a chair mounting rod 89 extended therethrough. The second bore extends perpendicular to the bore through which the shaft extends through the casting. The rods 89 may be part of, or mount, structure for supporting a user during use of the pontoon boat, for example, a chair, generally designated 44. Each of the castings instead of being made of one part may include a main body and and clamp plates bolted to the main body for removably securing the main body to the respective shaft 37*a*, 38*a* and the longitudinal rod 89 and the shaft in rotatable relationship to the casting.

Advantageously the chair is of the general type referred to as a lawn chair and has a seat 45 secured to rods 89, a leg rest 47 and a back 48. The back and leg rest may be angularly adjusted relative to the seat front and rear ends respectively, and retained in angularly adjusted positions by conventional structure (not shown) that does not form a part of this invention while the parts 45, 47, 48 of the chair may be appropriated curved for comfort of the user. Since the longitudinal spacing of the central axis of shafts 34, 35 is the same as the longitudinal spacing of the central axes of shafts 37*a*, 38*a*, and the radial spacing of the central axes of shafts 35, 38*a* is the same as the radial spacing of shafts 34, 37*a*, there is provided a parallel linkage system for retaining the chair seat in a generally horizontal condition as the linkage system is pivoted relative to the pontoons.

In order to provide a power operated linkage system, an electric motor-reducer combination 55 is mounted within pontoon 10 longitudinally intermediate the front and intermediate compartments to have its output shaft 56 located more closely adjacent to side wall 13 than side wall 14. A universal coupling 57 has one portion coupled to the output shaft and an opposite end coupled to the front end of a threaded rod 58. A nut 59 is threaded on the rod 58 and is pivotally connected by by pivots 61 to the clevised end of a forked member (crank arm) 60. The opposite end of the forked member is keyed to the adjacent front shaft 34. Pivots 61 also pivotally mount the front ends of link arms 62, the rear ends of the arms 62 being connected by a pivot 63 to the radial outer end of radial arm 64. The opposite end of the radial arm is mounted in a fixed angular relationship on rear transverse shaft 35. The spacing of the central axes of pivot 63 and shaft 35 is the same as the spacing of shaft 34 from pivots 61, while the spacing of the central axes of shafts 34, 35 is the same as the spacing of pivots 61, 63.

For each pontoon there is provided a reversible electric motor 68 having a propeller 69 keyed to its output shaft and is mounted in the respective tunnel on upright mounting member 70. There is provided a separate control module 71 mounted on a control panel arm 82. The control panel arm 82 is mounted by brackets 83 to be at one side of seat 45 and at a sufficiently higher elevation than the seat to be above water level when the seat has been moved to its lowermost position relative to the pontoons. The panel 82 mounts the manually operated controls used for controling the motors, lights (not shown), pump 75 and etc.

Each control module is electrically connected through a set of electric lines 90 to the respective motor 68. The negative input terminals of each module is electrically connected to the other by a line 91 which is electrically connected through line 92 to line 93. Line 93 is electrically connected to the negative terminals of the batteries 84. The positive input terminals of each module is electrically connected to the other by a line 96 that in turn is electrically connected to line 95. Line 95 is electrically connected by a line 94 to the positive terminals of the batteries.

Each of the control modules is of a conventional type which has a control member 97 for selectively varying the forward speed of operation, operable for reversing the motor drive of a motor 68 and operable to a stop position. For turning the boat the motors 68 may be operated at different forward speeds, or one operated and the other stopped, or one operated for forward drive and the other reverse drive. Thus if one motor 68 is operated in a reverse drive and the other in a forward drive, the pontoon boat may be turned very quickly while if for example one motor is operated at a slow forward speed and the other at a higher forward speed, the boat may be turned through a relatively gentle curve. That is the steering of the boat is controlled by operating the motors 68 at different forward and/or reverse speeds.

Advantageously batteries 84 are carried by each of the pontoons, for example in one of the compartments 27–29. Preferrably the batteries on one pontoon are electrically connected to the batteries on the other as indicated so that the power to each of the motors 68 is the same. The control lines from the control modules to the motors and the other electric controls on the control panel may be attached to the linkage arms 38*b* with a water tight plug connection (not shown) being provided adjacent to the respective bracket 36 with one part of the plug connection being mounted by the pontoon and the other by the bracket. As a result the parts of the control lines mounted by the pontoons being disconnectable from the part mounted by the linkage arms and/or chair permit easy disassembly of the arms from the pontoons and at the same time the lines are mounted in a manner not to be easily damaged. Advantageously the manner of attaching the control lines to arms 38*b* is of a type to permit easy disattachment from the arms in the event the arms are to be disattached from the chair and/or castings 36.

Figure 4:
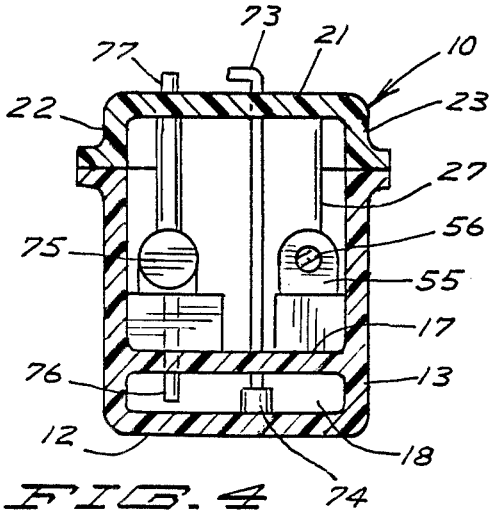
FIG. 4 is a transverse cross sectional view generally taken along the line and in the direction of the arrows 4—4 of FIG. 1, said view being somewhat diagrammatic.
Figure 5:
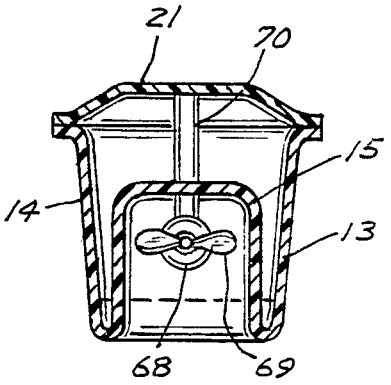
FIG. 5 is a transverse cross sectional view of one of the pontoons that is taken along the line and in the direction of the arrows 5—5 of FIG. 1.
Figure 8:
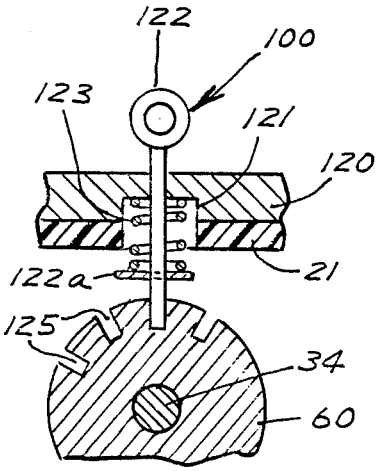
FIG. 8 is a schematic showing of a portion of the electrical circuitry of this invention.
Figure 6:
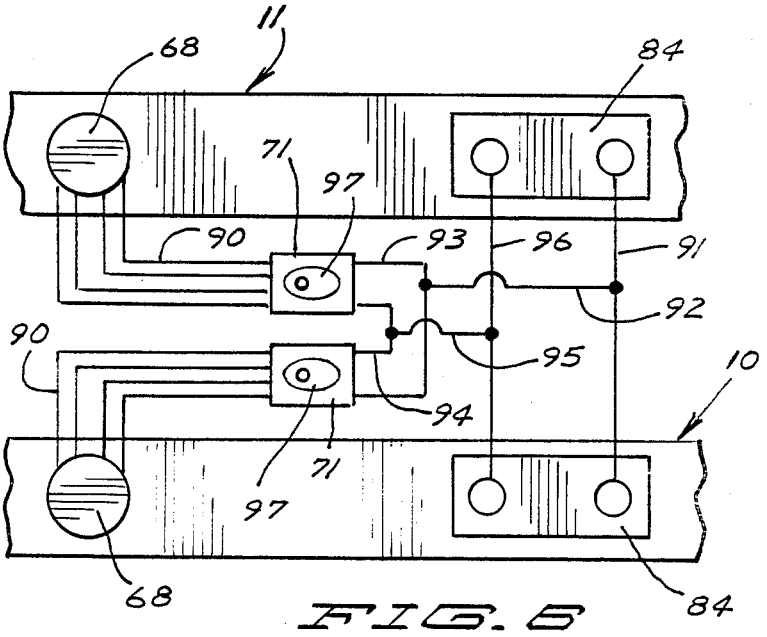
FIG. 6 is an enlarged, fragmentary, vertical cross sectional view that is generally taken along the line and in the direction of the arrows 6—6 of FIG. 2 of latching mechanism for locking the linkage system to retain the chair at a preselected elevation.

In order to maintain the propellers at a sufficient depth to facilitate control and operation of the boat when it is being used by a relatively light person, for example about 90 lbs. or less, the water tanks 18 can be filled by turning the control member 73 which extends through walls 17, 21 to open the valve 74 that permits water flow through the bottom wall of the respective pontoon (see FIG. 4). Then the valve is turned off. To empty the water tanks there is provided an electric pump 75 in each pontoon that has an inlet line 76 opening to the water tank and a discharge line 77 that opens exterior of the pontoon. Advantageously the pumps can be located within the pontoons longitudinally between the front and intermediate compartments. Vent lines (not shown) are provided to open through the top walls of the pontoons and to the water tanks to permit the flow of air to and from the tanks when the tanks are being emptied and filled.

When it is desired to lower the seat 45, the control on panel 82 for motor 55 is operated to move nut 59 in a rearward direction (arrow 106) which results in crank arms 60 pivoting in the direction of arrow 105. As a result the radial arms 37*b*, 38*b* pivot to lower the seat. It is to be noted that arms 37*b*, 38*b* are located transversely between the pontoons and are sufficiently spaced from the adjacent pontoons to preclude a persons arm being caught between an arm 37*b* or 38*b* and the adjacent pontoon. The chair is similarly mounted so that as it is moved between its elevated postion shown in solid lines in FIG. 1 and its lowered postion the users arms can not be pinched between a pontoon and the seat or an arm and the seat.

Even though the invention has been described with reference to electric motor 55 being mounted in the front part of the pontoon 10, it can be mounted in the rear portion, and additionally it can be mounted such that the chair in an elevated position imparts a rearwardly directed compressive force through rod 58 toward the motor rather than a pulling force such as would occur with the structure as shown in FIG. 1. Also in place of electric motors 55, 68 there may be provided hydraulic motors with the hydraulic pump for the motors being driven by an electric motor. Alternately motor 55 may drive an air compressor for providing fluid under pressure for operating a piston cylinder combination(s) that have a piston rod(s) connected to arm(s) 64 and the cylinder(s) pivotally mounted within a pontoon(s) longitudinally rearwardly of shaft 35. If a piston cylinder combination is used either a shock absorber is connected between an arm 64 that is connected to one of the shafts 35 and the pontoon body or a suitable flow control provided in the fluid line to the cylinder.

Advantageously there is provided latching mechanism, generally designated 110, for retaining shaft 35, or shaft 34 in a given angular position, particularly if a fluid operated piston cylinder combination is connected to one of pivots 63, 61 for moving the linkage mechanism between its positions. The latching mechanism includes a metal plate 120 that is mounted by the top wall 21 of pontoon 10 and has a downwardly facing recess 121 that opens through an aperture into the interior of the pontoon. The recess is located above shaft 34. A manually operated plunger 122 slideably extends through the plate, a coil spring 123 on the plunger bearing against the plate and an enlargd plunger portion 122*a* to constantly resiliently urge the plunger downwardly. The radial inner end portion of arm 60 is arcuately curved to have a circumferential end portion in which there is provided a plurality of circumferentially spaced apertures 125. The plunger in extending into one of the apertures prevents the shaft 34 from rotating and thereby holds the seat in an adjsuted elevated position. Advantageously the latching mechanism is of a type that upon retracting the plunger and turning it between 90° and 180° about its axis of elongation the plunger will be retained in its retracted position. Since the mechanism for retaining the plunger in a retracted condition may be any one of a number of different types and it need not be provided if a nut and screw type operating mechanism such as illustrated is used, it has not been shown nor disclosed in detail.

The provision of the pins 41 and the radially spaced apertures in brackets 36 in addition to permitting separation of the arms 37*b*, 38*b* from the pontoons, also permits the elevation of the maximum height and immersion of the seat being selectively varied by moving the pins from one set of apertures 40 to another. In breaking down the pontoon boat for transport between the place of use and the place of storage the pins 41 may be removed to separate the linkage members 37, 38, chair and castings from the pontoons. In preparing for transport, the parts of the electric lines extending along arms 38 are unplugged from the pontoons.

With the present invention the seat may be in an elevated position above the water when the boat is moving from one location to another, but when at a selected location may be lowered so that the lower part of the users body is immersed to be cooled by the water, if desired. The seat may be of a width to comfortably seat two persons.

In place of brackets 36 being made to permit adjustment of arm portions 37*b*, 38*b*, the radial inner (terminal) end portion may be suitably removably connected to the shafts 34, 35 to be retained in fixed angular relationship relative thereto. Also as in part indicated above when using the motor screw arrangement for moving the chair between its positions, assembly 110 may be disposed with.

In place of members 82, 83, chair arms (not shown) may have rear ends pivoted on back 48 while rear ends of braces (not shown) may be pivoted on shafts 38*a* and have front ends abuttable against the chair arms front end portions to releasably retain the arms in horizontal conditions while permitting the arms front end portions being pivoted upwardly and rearwardly. Suitable latch mechanism (not shown) may be provided for retaining such arms and braces in a latched position that the arms are retained in a horizontal position and upon being unlatched the braces and arms may be pivoted to an out of away position so that the user may be easily get onto and off seat 49. The controls may be mounted on such chair arms.

What is claimed is:

1. A pontoon boat for use by a user in a body of water, comprising a first and a second elongated pontoon that each has a top surface, a front end and a rear end, a chair for supporting a user, the chair having a chair seat, and means connected to both of the pontoons for retaining the pontoons in transversely spaced, parallel relationship and moving the chair between various selected elevations relative to the pontoon top surfaces, the above mentioned means including linkage means extending between the chair and pontoons for moving the chair between a position that the seat is at a higher elevation than the top surfaces of the pontoons and the surface of the body of water and a position that the seat is at a lower elevation than the surface of the body of water and power operated means mounted by one of the pontoons and connected to the linkage means for moving the linkage means to move the chair between the seat positions, the linkage means including a front and a rear transverse shaft mounted on the first pontoon for pivotal movement about parallel, transverse horizontal axes, a front and a rear transverse shaft mounted on the second pontoon for pivotal movement about parallel, transverse horizontal axes, a first front leg for the first pontoon, a second front leg for the second pontoon, each of the front legs having a first end joined to the respective front shaft to rotate therewith and second ends, front means pivotally attached to the chair for connecting the front legs second ends and moving the chair as the front shafts are rotated first and second rear legs having first ends connected to the first and second pontoon rear shaft respectively and second ends, and rear means pivotally attached to the chair for connecting the rear legs second ends and moving the chair as the rear shafts are rotated.

2. The pontoon boat of claim 1 further characterized in that the support means comprises a chair having a seat that has a front end portion and a rear end portion, a leg rest joined to the seat front end portion and a chair back joined to the seat rear end portion.

3. The pontoon boat of claim 2 further characterized in that the means for pivotally attaching the front legs to the support means includes a transverse front portion extending between and joined to the front legs second ends, means for pivotally mounting the seat front end portion on the transverse front portion, a transverse rear portion extending between and joined to the rear legs second ends and means for pivotally mounting the seat rear end portion on the transverse rear portion.

4. A pontoon boat for use by a user in a body of water, comprising a pair of elongated pontoons having front ends and rear ends, means for supporting a user, the support means having a front portion and a rear portion, operable means movably mounted on the pontoons and connected to the user support means for retaining the pontoons in parallel relationship and moving the user support means between a lowered position extending below the lever of the surface of the body of water and transversely between the pontoons and an elevated position above the surface of the body of water, and means mounted by at least one of the pontoons for selectively operating the operable means to move the user support means between the lowered and elevated positions and retain the support means in the selected one of the positions, the operable means including a parallel linkage system mounted on the pontoons for mounting and moving the support means between its positions, and the linkage system including first and second front legs having first ends pivotally connected to the first and second pontoon respectively and second ends, first and second rear legs having first ends pivotally connected to the first and second pontoon respectively, means for pivotally attaching the support means rear portion to the first and second rear legs second ends.

5. A pontoon boat for use by a user in a body of water, comprising a pair of elongated pontoons having front end portions and rear end portions, a chair for supporting a user, the chair having a front end portion, a rear end portion and a chair seat, and means mounted by the pontoons for retaining the pontoons in transversely spaced parallel relationship, selectively moving the chair between a lowered position that the chair seat is located below the surface of the body of water and covered by water and an elevated position in which the chair seat is located above the surface of the body of water, and retaining the chair in the selected position, the said means including a first elongated linkage having a first end portion pivotally connected to the front end portion of one of the pontoons and a second end portion pivotally connected to the chair front end portion and a second elongated linkage member having a first end portion pivotally connected to the rear end portion of one of the pontoons and a second end portion pivotally connected to the chair rear end portion.

6. The apparatus of claim 5 further characterized in that the first and second linkage members are pivotally connected to the first pontoon and that the said means includes a third elongated linkage member having a first end portion pivotally connected to the second pontoon front end portion and a second end portion pivotally connected to the chair front end portion and a fourth elongated linkage member having a first end portion pivotally connected to the second pontoon rear end portion and a second end portion pivotally connected to the chair rear end portion.

7. The pontoon boat of claim 5 further characterized in that each of the pontoons includes first wall means defining a downwardly and rearwardly opening tunnel and second wall means defining a ballast water tank extending forwardly of the tunnel means; and that there is provided for each pontoon, means opening to the respective water tank for selectively emptying and filling the tank, and power operated propelling means mounted on the respective pontoon and extending within the tunnel thereof for propelling and steering the boat.

8. A pontoon boat for use by a user in a body of water, comprising a first and second longitudinally elongated pontoon that each has a front end portion and a rear end portion, support means for supporting a user, the support means having a front end portion and a rear end portion and operative means mounted by the pontoons for retaining the pontoons in transversely spaced parallel relationship, selectively moving the user support means between a lowered position extending below the level of the surface of the body of water and transversely between the pontoons and an elevated position above the surface of the body of water and retaining the support means in the selected position, the operative means including a front linkage member having a first end portion pivoted on the support means front end portion and a second end portion, a transverse shaft having a transverse pivot axis, pivoted to the first pontoon front end portion and having the first linkage member second end portion keyed thereto to be pivoted thereby for moving the support means, a crank arm having a first end portion and a second end portion keyed to the transverse shaft, a nut pivotally mounted by the crank arm first end portion, a reversably, selectively operable motor mounted by the first pontoon, a longitudinally elongated threaded shaft having the nut threaded thereon and drivenly connected to the motor for being rotated thereby whereby the nut is moved to pivot the crank arm about the transverse shaft axis.

9. The apparatus of claim 8 further characterized in that the first pontoon has means enclosing the motor and elongated shaft.

10. The pontoon of claim 8 further characterized in that the operative means includes a rear linkage member having a first end portion pivotally connected to the support means rear end portion and a second end portion, a second transverse shaft having a transverse pivot axis, pivotally mounted to the first pontoon and having the rear linkage member second end portion mounted thereby.

11. The pontoon of claim 10 further characterized in that the operable means includes a second crank arm having a first end portion, and a second end portion keyed to the second transverse shaft, the rear linkage member being keyed to the second transverse shaft, and a link arm having a first end portion pivotally connected to the first crank arm first end portion and a second end portion pivotally connected to the second crank arm first end portion whereby the second crank arm is pivoted as the first crank arm is pivoted.

* * * * *